United States Patent [19]

Cantwell et al.

[11] Patent Number: 5,067,505

[45] Date of Patent: Nov. 26, 1991

[54] TENT

[75] Inventors: Robert R. Cantwell; Deborah M. Zumsteg, both of New Haven, Mo.

[73] Assignee: American Recreation Products, Inc., St. Louis, Mo.

[21] Appl. No.: 444,769

[22] Filed: Dec. 1, 1989

[51] Int. Cl.[5] ..... E04H 15/10

[52] U.S. Cl. ..... 135/104; 135/115; 135/119

[58] Field of Search ..... 135/104, 115, 119, 93, 135/94

[56] References Cited

U.S. PATENT DOCUMENTS

| | | | |
|---|---|---|---|
| 2,527,729 | 10/1950 | Hoff | 135/94 |
| 2,742,912 | 4/1956 | Blanchard | 135/104 |
| 3,474,802 | 10/1969 | Loring | 135/104 |
| 3,800,814 | 4/1974 | Hibbert | 135/104 |
| 3,970,096 | 7/1976 | Nicolai | 135/115 |
| 4,165,757 | 8/1979 | Marks | 135/104 |
| 4,491,141 | 1/1985 | Eppenbach | 135/104 |
| 4,745,936 | 5/1988 | Scherer | 135/104 |

FOREIGN PATENT DOCUMENTS

| | | | |
|---|---|---|---|
| 2622367 | 12/1977 | Fed. Rep. of Germany | 135/119 |
| 776627 | 1/1935 | France | 135/93 |
| 976891 | 3/1951 | France | 135/119 |

*Primary Examiner*—Henry E. Raduazo

*Attorney, Agent, or Firm*—Senniger, Powers, Leavitt & Roedel

[57] ABSTRACT

A tent including a shell of flexible tent material which is supported internally of the shell by an internal frame. Waterproof fly panels are integrally attached to the shell on the outside of the shell.

5 Claims, 4 Drawing Sheets

TENT

BACKGROUND OF THE INVENTION

This invention relates generally to tent constructions and, more specifically, to a tent which is designed to be quickly erected from one side of the tent by a single person.

Tents of conventional construction are typically time-consuming to erect. For example, tents with conventional internal frames are typically erected by inserting the frame members into the tent through the door of the tent when the tent is lying flat on the ground. Then the person erecting the tent must enter the tent while the tent is still flat to erect the frame, which is an inconvenient and often unpleasant task. While tents supported by external frames avoid the problem of entering the tent before it is erect, attachment of the tent to the frame usually requires the efforts of two persons, or one person walking around the tent to make the necessary attachments. Moreover, if a fly is used (as in most cases), it must be installed on the tent in a separate operation after erection of the tent.

SUMMARY OF THE INVENTION

Among the several objects of this invention may be noted the provision of an improved tent which is designed for quick and easy erection by a single person from one side of the tent; the provision of such a tent which is equipped with waterproof fly panels integrally attached to the shell of the tent on the outside of the tent; the provision of such a tent wherein the fly panels are arranged to control the flow of condensation out and away from the tent; the provision of such a tent which has greater stability in high winds; the provision of such a tent which is designed to allow field repair of the frame from inside the tent for convenience during inclement weather; the provision of such a tent which is designed for spreading the load on the tent equally across the frame; and the provision of such a tent which is of economical construction.

Briefly, a tent of this invention comprises a shell of flexible tent material, a frame for supporting the shell and waterproof fly means integrally attached to the shell on the outside of the shell.

In a second aspect of the invention, the tent of this invention comprises a shell of flexible tent material, and an internal frame for supporting the shell internally of the shell. The frame comprises a plurality of poles having end portions adapted to exit the shell throuqh openinqs in the shell adjacent the bottom thereof, and means on the outside of the shell for holding said end portions of the poles.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
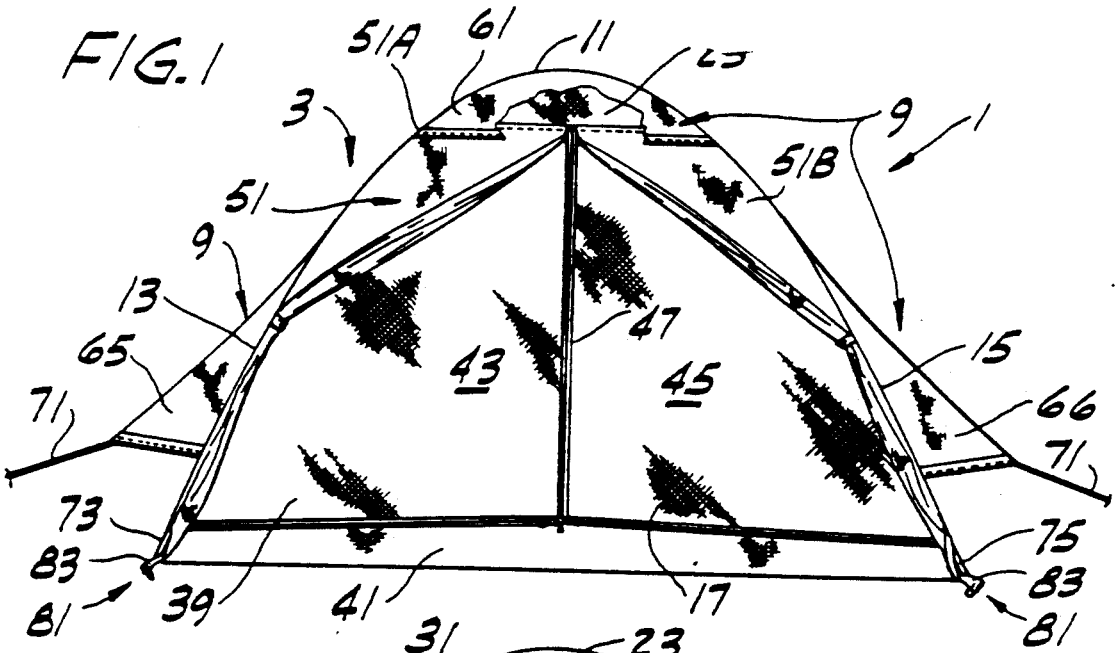
FIG. 1 is front elevation of a tent of the present invention.

Referring now to the drawings, a tent constructed according to the principles of this invention is designated in its entirety by the reference numeral 1. The tent comprises a dome-shaped shell, generally designated 3, made of flexible material and supported internally of the shell by a frame 5. Waterproof fly means, indicated generally at 9, is integrally attached to the shell 3 on the outside of the shell and covers portions of the shell. The shell 3 has a roof 11, a left (as viewed in FIG. 1) side wall 13, a right side wall 15 opposite the left side wall, a front wall 17, a rear wall 19 and a floor 21. The side walls 13, 15 are attached at their bottom edges by suitable means to respective side edges of the floor 21. The front wall 17 is attached at its bottom edge by suitable means to a front edge of the floor 21, and the rear wall 19 is similarly attached at its bottom edge to a rear edge of the floor.

Figure 2:
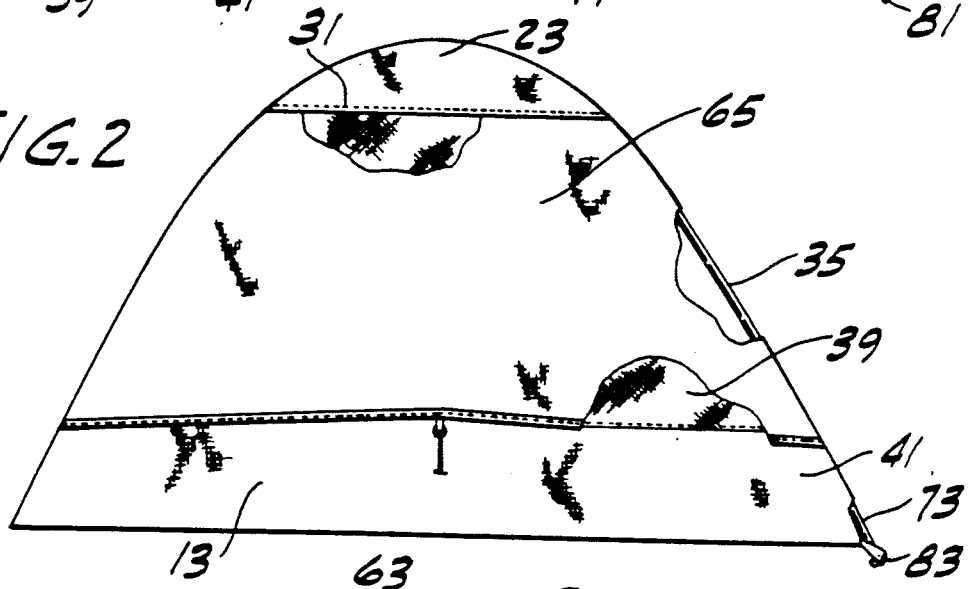
FIG. 2 is a left side elevation of the tent.
Figure 4:
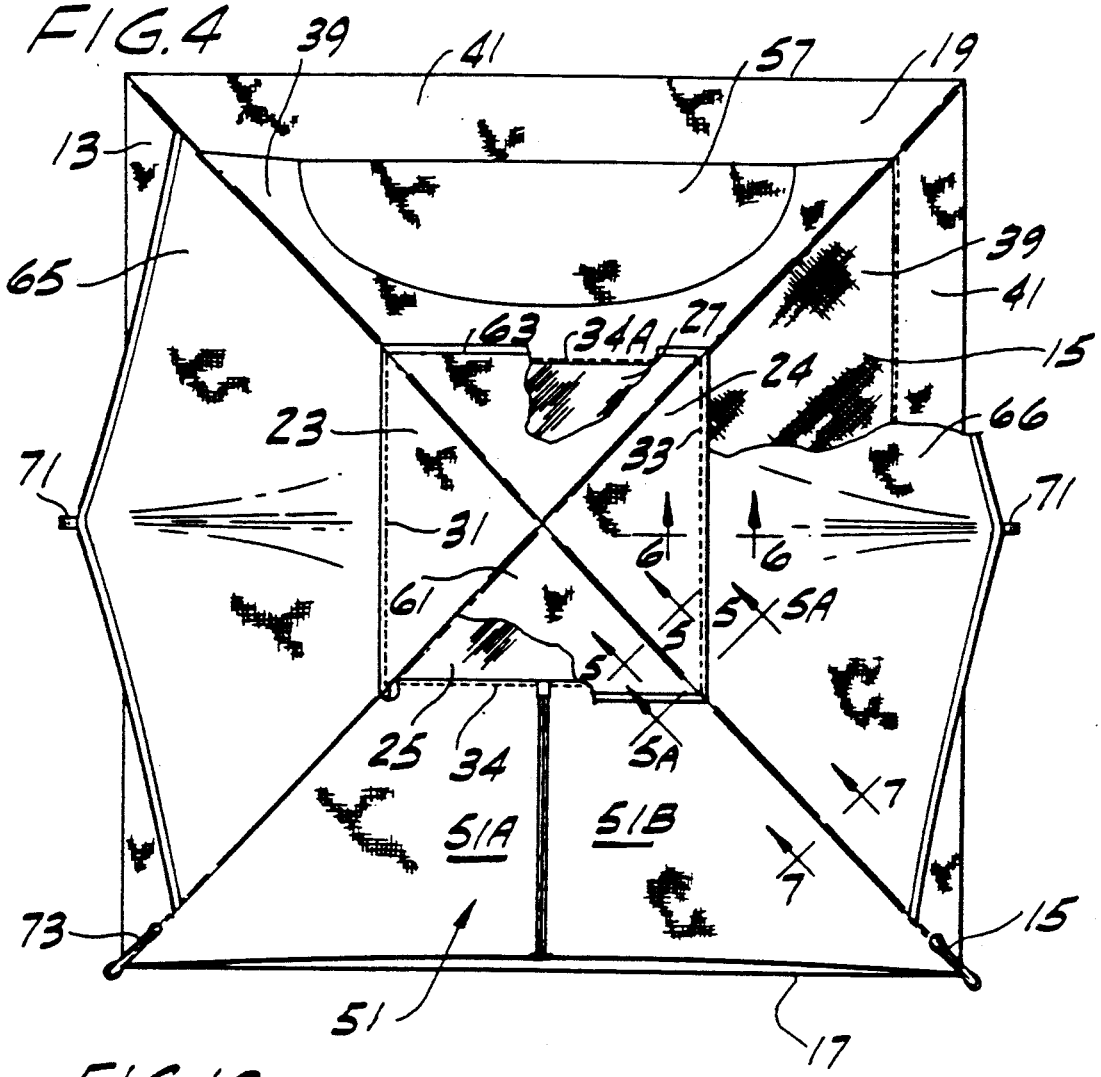
FIG. 4 is a top plan of the tent.

The roof 11 includes a left side panel 23, a right side panel 24, a front panel 25 and a rear panel 27. The side panels 23, 24 are made of waterproof material and the front and rear panels 25, 27 are made of mesh material to provide ventilation inside the tent 1. As shown in FIGS. 2 and 4, the side roof panels 23 are attached by lines of stitching, designated 31 and 33, respectively, to the top edges of the left and right side walls 13, 15. The bottom edge of the front roof panel 25 is attached to the top edge of the front wall 17 by stitching 34 and the bottom edge of the rear roof panel 27 is attached to the top edge of the rear wall 19 by stitching 34A (FIG. 4).

The left side wall 13 of the shell 3 is attached at its front edges by stitching 35 to the left side edge of the front wall 17 (FIG. 2). The right side wall 15 of the shell 3 is attached by identical stitching 36 (FIG. 5) to the right side edge of the front wall 17. The side walls 13, 15 are attached at their rear edges by similar lines of stitching (not shown) to respective side edges of the rear wall 19. The front roof panel 25 is also joined at its left side edge to the front edge of the left side roof panel 23 by the same stitching 35 which joins the front wall 17 to the left side wall 13. The right side edge of the front roof panel 25 is joined to the front edge of the right side roof panel 24 by the stitching 36 joining the front wall 17 and the right side wall 15. Likewise, the side edges of the rear roof panel 27 are joined to the rear edges of side roof panels 23, 24 by the same lines of stitching joining the side walls 13, 15 to the rear wall 19 of the shell 3.

The walls of the shell 3 each include an upper panel 39 and a lower panel 41. The upper panels 39 of the front and side walls are made of mesh material to provide ventilation in the tent 1 for preventing condensation inside the tent. As shown in FIG. 1, the upper panel 39 of the front wall 17 consists of two sections, designated 43 and 45, connected together by a slide fastener 47 or other suitable fastener so that the upper panel can be opened and closed as desired. As best seen in FIG. 4, the tent 1 has a waterproof door panel generally designated 51 adapted to cover the mesh upper panel 39 of the front wall 17 to prevent the entry of precipitation into the tent. The door panel 51 is attached along its top edge to the bottom edge of the front roof panel 25 and the top edge of the front wall 17. The side edges of the door panel 51 are attached to the front edges of the side walls 13, 15 and the side edges of the front wall 17 by the same lines of stitching 35, 36 attaching the front wall to the side walls. The bottom edge of the door panel 51 is free of connection to the shell 3. The door panel includes two sections 51A, 51B which may be opened (FIG. 1) or closed (FIG. 4).

Figure 3:
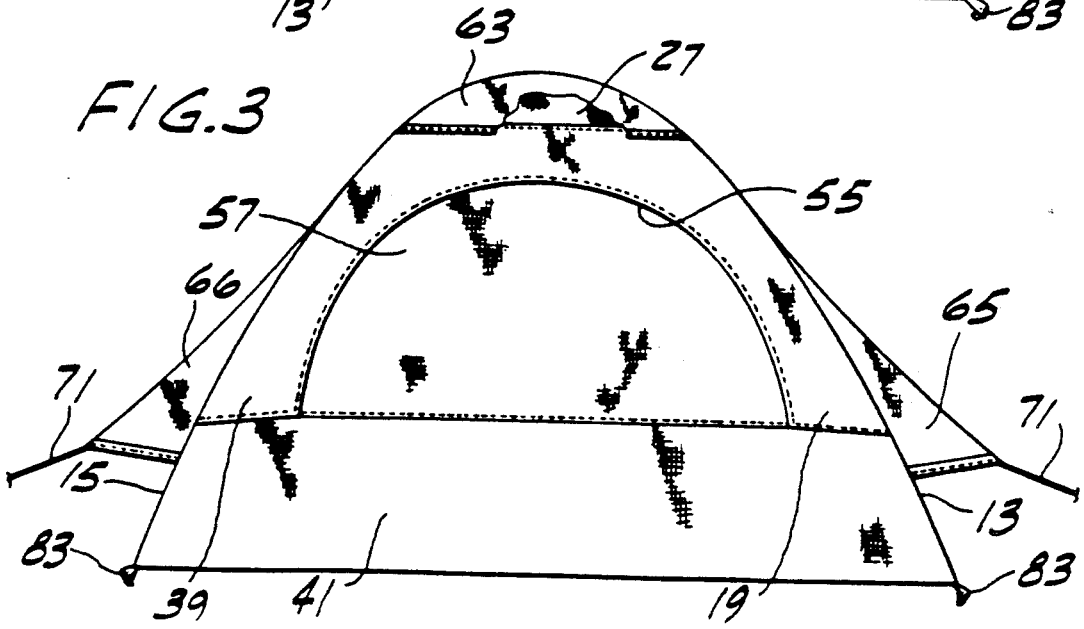
FIG. 3 is a rear elevation of the tent.
Figure 9:
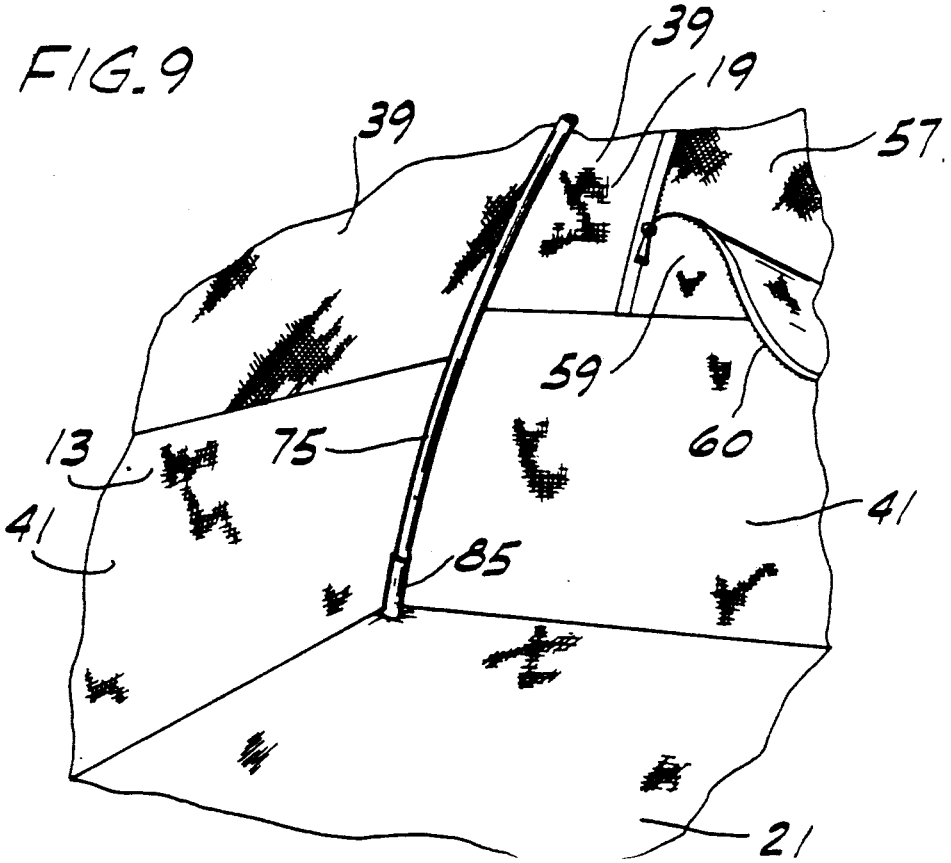
FIG. 9 is a fragmentary perspective inside the tent showing a corner thereof.

As shown in FIG. 3, the upper panel 39 of the rear wall 19 is formed with a generally semi-circular opening 55 which is covered by a generally semi-circular web 57 of mesh material attached at its edges to the upper and lower panels 39, 41 of the rear wall 19. As best seen in FIG. 9, a semi-circular panel 59 of waterproof material is seamed inside the mesh web 57 to the lower panel 41 of the rear wall 19. The curved top edge of the panel 59 of waterproof material is releasably connected to the upper panel 39 of the rear wall 19 by a suitable fastener 60 (e.g. a slide fastener) so that the semi-circular waterproof panel 59 may either be removed from the mesh material to increase ventilation or secured over the semi-circular mesh portion to close the opening 55.

Figure 5:
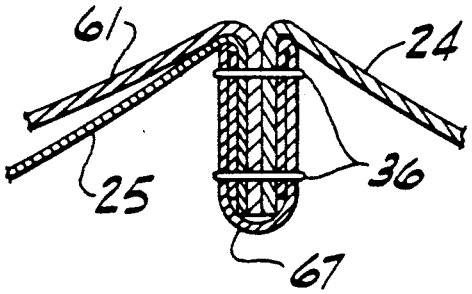
FIG. 5 is a cross section of a seam of the tent taken in the plane including line 5—5 of FIG. 4.
Figure 5A:
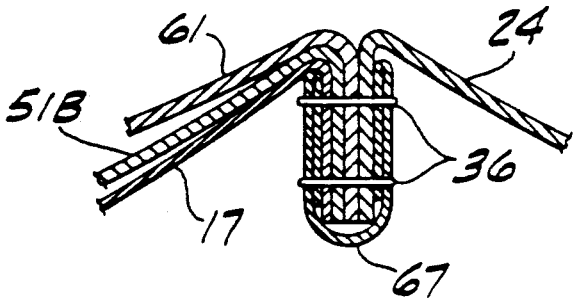
FIG. 5A a cross section of a seam of the tent taken in the plane including line 5A—5A of FIG. 4.
Figure 11:
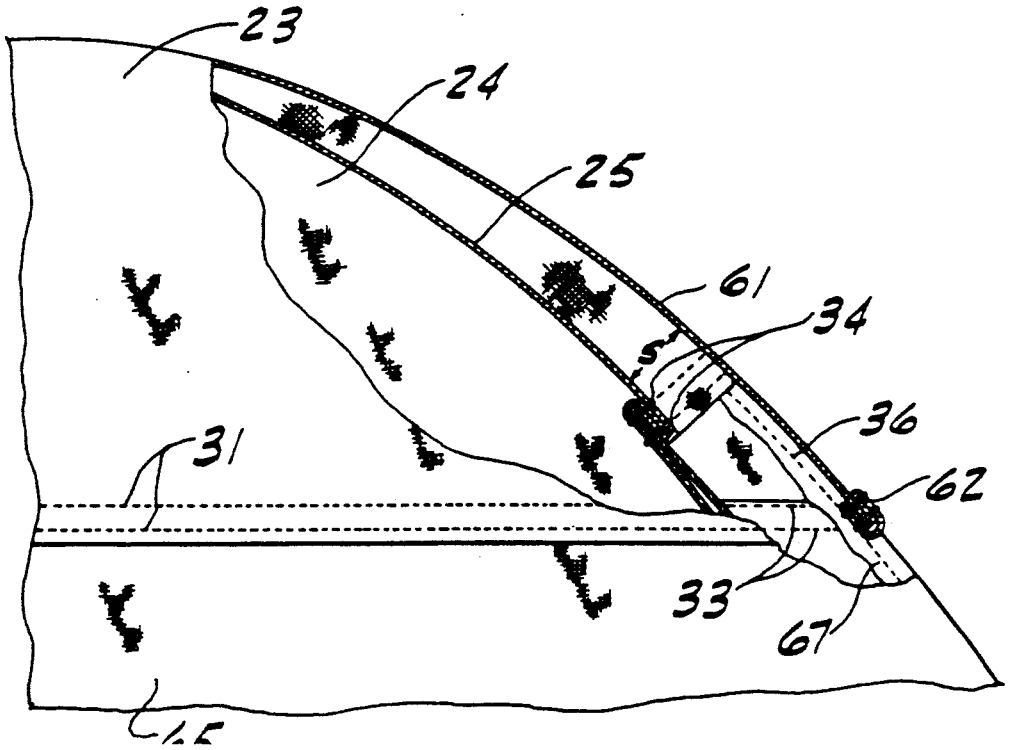
FIG. 11 is a fragmentary front elevation showing the spacing of a roof fly panel from a roof panel of the tent.

The waterproof fly means 9, which prevents the entry of moisture into the tent 1 through the mesh portions of the shell 3, includes a front fly roof panel 61, a rear fly roof panel 63, a left side fly panel 65 and a right side fly panel 66 overlying different parts of the shell. The front and rear fly roof panels 61, 63 overlie, respectively, the front and rear roof panels 25, 27 and the upper portions of the front and rear walls 17, 19 of the shell 3. The side edges of the front fly panel 61 are seamed to the front edges of the side roof panels 23, 24 along the entire lengths of the panels by the lines of stitching 35, 36 which join the side edges of the front roof panel 25 and front wall 17 to the side roof panels and side walls 13, 15. As shown in FIG. 5, the stitching 36, at the position indicated by line 5—5 in FIG. 4, attaches the front roof panel 25, the side roof panel 24, and the front fly roof panel 61, the edqes of which are received in binding 67. As shown in FIG. 5A, adjacent the lower right hand edge of the front fly roof panel 61, the stitching 36 attaches the front wall 17, right door section 51B, the side roof panel 24 and the front fly roof panel. The front fly roof panel 61 is attached in the same way at its left side to the shell by stitching 35. The bottom edge of the front fly roof panel 61 is unattached to the shell 3 and is received in binding 62 which is seamed to the panel. As illustrated in FIG. 11, the width of the front fly roof panel 61 is such that it is tensioned over the frame 5 between the lines of stitching 35, 36 to maintain the front fly panel spaced away from the front roof panel 25 of the shell 3. The spacing is indicated by reference character S in FIG. 11. Similarly, the side edges of the rear fly panel 63 are seamed to the rear edges of the side roof panels 23, 24 along the entire lengths of the panels by the respective lines of stitching (not shown) joining the side edges of the rear roof panel 27 and rear wall 19 to the side roof panels and side walls 13, 15. The bottom edge of the rear fly roof panel 63 is also unattached to the shell 3 and its width is such that it is tensioned over the frame 5 between the lines of stitching to maintain the rear fly roof panel 63 spaced away from the shell.

Figure 6:
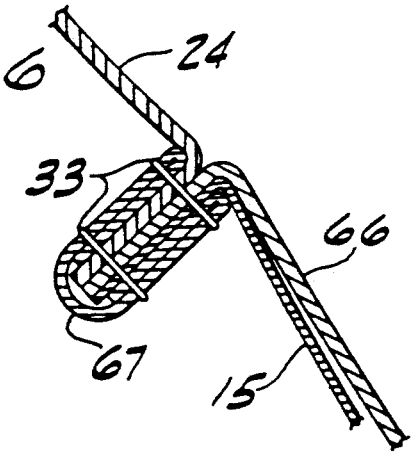
FIG. 6 is a cross section of a seam of the tent taken in the plane including line 6—6 of FIG. 4.
Figure 7:
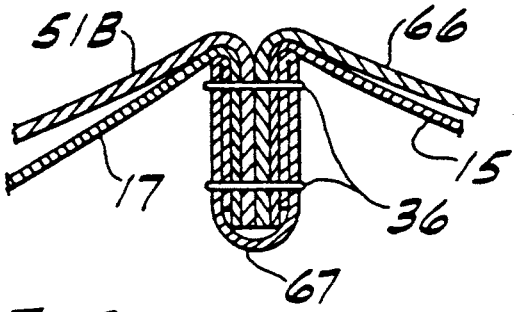
FIG. 7 is a cross section of a seam of the tent taken in the plane including line 7—7 of FIG. 4.

As shown in FIG. 6, the right side fly panel 66 has a top edge which is seamed by the stitching 33 connecting the right side roof panel 24 to the right side wall 15 of the shell 3. The left side fly panel 65 is similarly attached at its top edge to the left side roof panel 23 and left side wall 13 by stitching 31. As may be seen in FIG. 7, the front side edge of the right side fly panel 66 is seamed to the shell by the stitching 36 which also joins the front wall 17, the door panel section 51B and right side wall 15 of the shell 3. The rear side edge of the right side fly panel 66 is similarly attached to the right side edge of the rear wall 19, and the front and rear side edges of the left side fly panel 65 are attached to the front and rear walls in the same way as the right side fly panel. The bottom edges of the side fly panels 65, 66 are unattached to the shell 3. Guy means for pulling the bottom edge of the side fly panels 65 outwardly away from the shell 3 to space the fly panel from the shell constitutes in the preferred embodiment a length of cord 71 attached to the center of the bottom edge of each side fly panel between the lower corners of the panel. The cords 71 may be staked to the ground or fastened to another object to hold the bottom edges of the side fly panels 65, 66 away from the sidewalls 13, 15 of the shell 3 so air may flow to and from the inside of the tent 1 through the mesh upper panels 39 of the side walls. As illustrated in FIGS. 1 and 4, the pull on the side fly panels forms the panels into inverted troughs or channels for directing condensate escaping the tent away from the tent, as explained thereinafter.

The separation of the fly panels 9 from the shell 3 is important when the waterproof portions of the tent 1 are constructed of non-breathable material such as methane-coated nylon. When such material is used, moisture in the air on the inside of the shell 3 tends to condense on the inner surface of the shell and dampen articles in the tent 1. The mesh portions of the walls ventilate the inside of the tent and thus reduce condensation. Further, because the fly panels 61, 63, 65, 66 of the present invention are spaced away from the shell 3 and slope away from the shell, any condensate collecting on the undersides of the fly panels is allowed to run down the inside of the fly panel and away from the mesh portions of the shell so that moisture does not fall into the tent 1. Because the fly panels 9 are integrally attached to the tent 1, it is not necessary to erect another frame separate from the tent frame to support them. The only step required to finally position the fly panels after erection of the tent is to tie down the cords 71. The integral connection of the fly panels to the shell 3 saves materials in manufacture of the tent 1 and provides greater stability in high wind compared to tents with fly panels which are merely tied to the tent shell.

Figure 10:
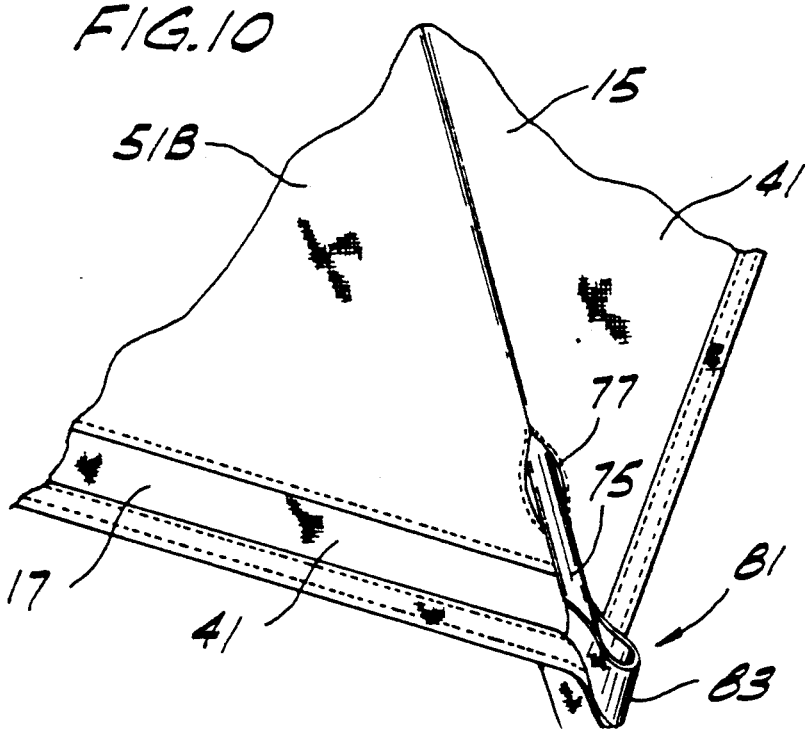
FIG. 10 is a fragmentary perspective showing an exit opening at a lower front corner of the tent.
Figure 8:
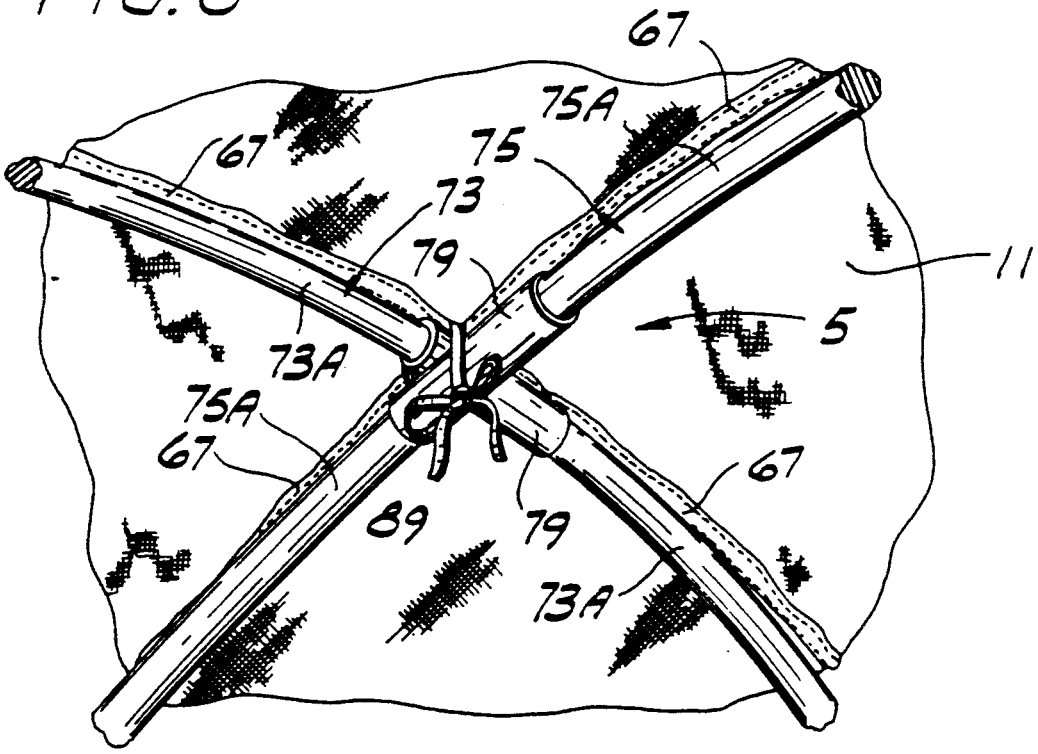
FIG. 8 is a fragmentary perspective inside the tent showing a portion of the frame.

The frame 5 supports the shell 3 internally of the shell and includes two resilient poles, generally designated 73 and 75, respectively, adapted to be positioned inside the shell. As shown in FIG. 8, each pole is generally of inverted U-shape and comprises a series of separate pole sections (indicated at 73A for pole 73 and 75B for pole 75) connected together end-to-end by suitable tubular connectors 79. As shown in FIG. 10, the lines of stitching 35, 36 attaching the side edges of the lower panels 41 of the front wall 17 to the front edges of the side walls 13, 15 have a break adjacent at the top of the lower panels leaving exit openings 77 in the shell 3. The front end portions of the poles 73, 75 are adapted to exit the shell 3 through the exit openings 77 adjacent the bottom of the front wall 17 of the shell and are received in holding means, indicated generally at 81, on the outside of the shell. Holding means 81 comprises pockets 83 attached to the lower corners of the front wall 17 of the shell 3. There is only one exit opening 77 in the shell 3 for each pole, so that only the front end portion of each pole is adapted to exit a respective exit opening in the shell. As illustrated in FIG. 9, the rear end portion of the poles 73, 75 are disposed inside the tent at respective rear corners of the tent and are not attached to the tent. The rear end portions have tips 85 of rubber or a like material to protect the shell 3.

The tent of this invention is so constructed that any repairs to the frame 5 which must be made in the field can be carried out while inside the tent, which is particularly advantageous in inclement weather. Stress applied to the frame 5 such as by wind is distributed over the entire frame because the frame is internal and the force of the wind is applied over the outer surfaces of the wall. Tents having external frames are typically designed so that the frame members are tied to the shell or received through looped straps stitched to the shell. In this situation, stress applied to the frame is applied at the points of connection of the tent shell to the frame rather than over the entire frame, thus increasing the likelihood of failure.

The tent 1 of the present invention has the additional advantage that it may be quickly erected with only a minimum of effort by one person from one side of the tent. To do this, the shell 3 of the tent is laid out with its floor 21 flat on the ground with the side, front and rear walls and roof collapsed upon it. While standing on the front side of the tent, the person erecting the tent then inserts a first pole 73 or 75 through one of the exit openings 77 in the shell 3 in a diagonal direction across the floor 21 to an opposite bottom corner at the rear of the shell. After the pole engages the opposite bottom corner or portion of the shell 3 on the inside of the shell (FIG. 9.), it is resiliently bent to an erect position in which it is of inverted U-shape to support part of the shell. The front end portion of the pole projecting through the exit opening 77 is inserted into the pocket 83 which holds the pole in its bent position. The second pole 73 or 75 is then inserted through the other exit opening 77 in the shell 3 and bent to support the shell in the same way as the first pole. As shown in FIG. 8, the poles cross generally at the peak of the shell 3 where means, constituted in the preferred embodiment by ties 89 secured to the roof 11, releasably connect the shell to the poles 73, 75. As shown in FIGS. 8 and 9, except for the ties 89 the poles are unconnected to the tent intermediate their ends. The tent 1 may thus be erected while standing outside the shell 3 and while remaining on one side of the tent throughout the erection procedure. The number of parts of the frame 5 and tent 1 are few, making it less likely that the frame will be improperly assembled and therefore reducing the chance of failure of the frame. It is to be understood that the number of poles used for the frame and the configuration of the poles inside the tent are not critical to the invention.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A tent comprising a shell of flexible tent material having an interior surface, an exterior surface, and a bottom, an internal frame comprising a plurality of poles for supporting the shell internally of the shell, and a plurality of exit openings, one for each pole, in the shell generally adjacent the bottom of the shell whereby a single person outside of the shell may erect the tent by inserting each pole, end first, into the interior of the tent through a respective exit opening in the shell and moving the pole across a floor of the tent to a position in which one end of the pole engages a bottom portion of said interior surface of the shell at a side of the tent generally opposite the exit opening and the other end of the pole projects out of the tent through said exit opening, said pole thereafter being adapted to be moved by said person to an erect position in which the pole is engageable with an overhead portion of said interior surface of the shell for holding the tent erect, means on the shell for holding said other end of each pole projecting out through the exit opening when the pole is erect, and means on said overhead portion of the interior surface of the shell engageable with the poles only after they have been erected for releasably holding the poles erect.

2. A tent as set forth in claim 1 wherein said poles are resilient poles which, after insertion into the tent, are adapted to be resiliently bent to an inverted U-shape to support the shell of the tent, said poles being maintained in their bent shape by the reception of their said other ends in said holding means and engagement of their said one ends with said shell on the inside of the tent.

3. A tent as set forth in claim 1 wherien said holding means comprises a pocket attached to the shell of the tent at the bottom of the shell.

4. A tent as set forth in claim 1 wherein said holding means comprises tie means for releasably connecting the shell to said poles, said poles being unconnected to the tent intermediate their ends except for said tie means.

5. A tent comprising a shell of flexible tent material having an interior surface, an exterior surface, and a bottom, an internal frame comprising a plurality of poles for supporting the shell internally of the shell, and a plurality of exit openings, one for each pole, in the shell generally adjacent the bottom of the shell whereby a single person outside of the shell may erect the tent by inserting each pole, end first, into the interior of the tent through a respective exit opening in the shell and moving the pole to a position in which one end of the pole engages a bottom portion of said interior surface of the shell at a side of the tent generally opposite the exit opening and the other end of the pole projects out of the tent through said exit opening, said pole thereafter being adapted to be moved by said person to an erect position in which the pole is engageable with an overhead portion of said interior surface of the shell for holding the tent erect, means on the shell for holding said other end of each pole projecting out through the exit opening when the pole is erect, said shell being dome-shaped and said frame comprising a pair of resilient poles adapted to be resiliently bent to an inverted U-shape to support the shell generally at the peak of the shell, and means for releasably connecting the shell to the poles at the point where the poles cross.

* * * * *